US005330338A

United States Patent [19]

Nakata et al.

[11] Patent Number: 5,330,338

[45] Date of Patent: Jul. 19, 1994

[54] APPARATUS FOR SPINNING OF POLYURETHANE ELASTIC FILAMENTS

[75] Inventors: Kiyoshi Nakata, Tsuruga; Seishu Hayashi, Otsu, both of Japan

[73] Assignee: Toyo Boseki Kabushiki Kaisha, Osaka, Japan

[21] Appl. No.: 18,534

[22] Filed: Feb. 17, 1993

[30] Foreign Application Priority Data

Feb. 17, 1992 [JP] Japan ..... 4-069264
Feb. 18, 1992 [JP] Japan ..... 4-069493
Feb. 18, 1992 [JP] Japan ..... 4-069494

[51] Int. Cl.[5] ..... D06B 1/08

[52] U.S. Cl. ..... 425/94; 8/151.2; 68/200; 118/420; 264/210.3; 425/377; 425/382.2; 425/464

[58] Field of Search ..... 425/377, 382.2, 464, 425/94; 264/136, 210.3, 210.4; 68/200; 8/151.2; 118/420

[56] References Cited

U.S. PATENT DOCUMENTS 1,934,796 11/1933 Friederich ..... 68/200
3,754,530 8/1973 Pierce ..... 118/420
3,988,086 10/1976 Marshall et al. ..... 264/210.3
4,051,807 10/1977 Graf et al. ..... 118/420
4,253,416 3/1981 Williams, Jr. ..... 118/420
4,255,472 3/1981 Williams, Jr. ..... 118/420
4,255,473 3/1981 Williams, Jr. ..... 118/420
4,268,550 5/1981 Williams, Jr. ..... 118/420
4,329,750 5/1982 Binnersley ..... 8/151.2
4,397,164 8/1983 Binnersley ..... 68/200
4,605,573 8/1986 Deeg et al. ..... 118/420
4,719,771 1/1988 Brough et al. ..... 68/200
4,891,960 1/1990 Shah ..... 68/200

*Primary Examiner*—Jay H. Woo
*Assistant Examiner*—Joseph Leyson
*Attorney, Agent, or Firm*—Wegner, Cantor, Mueller & Player

[57] ABSTRACT

There is disclosed an apparatus for spinning of polyurethane elastic filaments, which includes an improved means for application of a finishing agent and/or an improved means for false twisting. Each of the improved means has a groove through which a polyurethane elastic filament is allowed to pass, at which time a finishing agent is applied to the passing filament before its contact with any solid face of the apparatus.

5 Claims, 9 Drawing Sheets

APPARATUS FOR SPINNING OF POLYURETHANE ELASTIC FILAMENTS

FIELD OF THE INVENTION

This invention relates to an apparatus for spinning of polyurethane elastic filaments, which comprises a means for false twisting of continuously spun filaments of a polyurethane material and a means for application of a finishing agent to the filaments. More particularly, it relates to an improvement of these means, which can attain the spinning of polyurethane elastic filaments without degrading their characteristics, for the purpose of obtaining polyurethane elastic filaments with excellent evenness.

BACKGROUND OF THE INVENTION

It is well known in the spinning of polyurethane elastic filaments that a liquid finishing agent such as an oil is applied to the filaments for prevention of their damage which may be caused by their abrasion, and conferring smoothness thereon to facilitate their handling in the subsequent steps.

A conventional means for application of a finishing agent takes a roller system in which a roller partially immersed in a bath containing the finishing agent is rotated to form a uniform layer of the finishing agent on the roller surface and a polyurethane elastic filament is allowed to run while being brought into contact with this surface to apply the finishing agent thereto.

Another example is a guide system, so called in general, in which a finishing agent such as an oil is supplied to a slit or groove provided in the guide and a polyurethane filament is allowed to run through the slit or groove to apply the finishing agent thereto.

It is also well known that spun filaments of a polyurethane material are subjected to false twisting upstream in their running direction from the finishing agent applying means. FIG. 1 shows the schematic diagram of a conventional apparatus for spinning of polyurethane elastic filaments. In this apparatus, a melt or solution of a polyurethane material is supplied from the conduit 12 and extruded through the spinning nozzle 14 into the spinning tube 15. At that time, warm air or cold air is always introduced from the inlet 13 into the spinning tube 15 and exhausted through the outlet 16. The air flow facilitates the formation of a filament 4 from the extruded melt or solution. The filament 4 coming out through a slit at the bottom of the spinning tube 15 is subjected to false twisting by the false twisting means 17, and a finishing agent is applied to the false twist filament by the finishing agent applying means 18, after which the false twist filament is wound up on the first roller 19 or allowed to turn its running direction to a certain direction for final winding.

In a conventional means for application of a finishing agent, whichever it takes either the roller system or the guide system as described above, a polyurethane elastic filament, although it is finally wound up with a winding machine after the application, is inevitably brought into contact with the application face of this means before or simultaneously with the application. The filament before its contact with the application face is in an extremely unstable state (i.e., not yet completely solidified), which is aggravated by a variation in the frictional resistance on this face, so that the properties of the wound filament, particularly its evenness, may be adversely affected.

Further, in the conventional spinning apparatus, when a polyurethane elastic filament is subjected to false twisting with a revolving gas flow or by mechanical rotation, it is brought into contact with a certain solid face of the false twisting means at the time of false twisting. A variation in the running frictional resistance of the filament is caused by the false twisting or its contact with the solid face. This variation has an adverse effect on the filament in an unstable state, i.e., not yet completely solidified, just after the extrusion through the spinning nozzle, to cause a phenomenon such as waviness and cramp in the filament, which may adversely affect on the evenness of the filament and may finally give rise to even filament breaking.

SUMMARY OF THE INVENTION

Under these circumstances, the present inventors have extensively studied the mechanisms of a finishing agent applying means and a false twisting means, which are to be disposed in the apparatus for spinning of polyurethane elastic filaments, and they have found that polyurethane elastic filaments with excellent properties, particularly excellent evenness, can be obtained by applying a finishing agent to the filaments before their contact with any face of the apparatus.

That is, the present invention provides in one aspect an apparatus for spinning of polyurethane elastic filaments, which comprises: a spinning nozzle through which a polyurethane material is extruded to form a polyurethane elastic filament; a means for application of a finishing agent to the filament, which is arranged downstream in the running direction of the filament from the spinning nozzle, said means having a guide provided with a groove through which the filament is allowed to pass, at which time a finishing agent supplied from an opening formed on the inner surface of the groove is applied to the passing filament, said inner surface of the groove having an apex on the bottom of the groove, at which the filament is to be brought into contact with the guide, as well as having an upper inclined plane and a lower inclined plane with respective angles away from the filament with an increase in the distance from the apex, sidewalls of the groove forming a narrowest portion in the width direction of the groove in the vicinity of the apex, said opening for supplying the finishing agent being formed at the position at least 3 mm higher than that of the apex and at least 2 mm apart from the filament, and said opening having a diameter greater than the groove width at the narrowest portion; and a roller for winding up the filament thus treated with the finishing agent.

In a preferred embodiment, the degree of surface roughness at the apex of the above finishing agent applying means is 2 to 10 S.

In a preferred embodiment, the angle between the above upper inclined plane and the filament and the angle between the above lower inclined plane and the filament are independently in the range of 15 to 70 degrees in the depth direction of the groove and angles formed between the sidewalls respectively above and below the apex are in the range of 20 to 50 degrees in the width direction of the groove.

In a preferred embodiment, the above narrowest portion has a width in the range of 0.1 to 5 mm.

In a preferred embodiment, the above opening for supplying a finishing agent has a maximum diameter on the inner surface of the groove, which is 0.2 to 0.4 mm greater than the minimum width of the groove at the narrowest portion.

The present invention provides in another aspect an apparatus for spinning of polyurethane elastic filaments, which comprises: a spinning nozzle through which a polyurethane material is extruded to form a polyurethane elastic filaments; a means for application of a finishing agent to the filament, which is arranged downstream in the running direction of the filament from the spinning nozzle, said means having a groove through which the filament is allowed to pass, at which time the finishing agent supplied to the groove is applied to the passing filament, said groove having a width decreasing with an increase in the distance from the inlet thereof and having a narrowest portion at which the filament is to be brought into contact with the inner surface of the groove, and a lower part of said inner surface of the groove, including the narrowest portion, within a distance of at least 3 mm from the narrowest portion being made of a porous material to supply the finishing agent; and a roller for winding up the filament thus treated with the finishing agent.

In a preferred embodiment, the distance from the inlet to the narrowest portion of the above groove is in the range of 10 to 50 mm.

In a preferred embodiment, the angle between the inner surface of the above groove and the filament is in the range of 5 to 40 degrees.

In a preferred embodiment, the above lower part made of a porous material has a mean pore size of 0.1 to 10 μm.

Further provided is an apparatus for spinning of polyurethane elastic filaments, which comprises: a spinning nozzle though which a polyurethane material is extruded to form a polyurethane elastic filament; a means for false twisting of the filament, which is arranged downstream in the running direction of the filament from the spinning nozzle, said means having a portion for false twisting of the filament and a portion for application of a finishing agent to the filament, which is positioned upstream in the running direction of the filament from the false twisting portion; a means for application of a finishing agent to the false twist filament, which is arranged downstream in the running direction of the filament from the false twisting means; and a roller for winding up the false twist filament thus treated with the finishing agent.

In a preferred embodiment, the finishing agent applying portion of the above false twisting means has a groove through which the filament is allowed to pass,- at which time the finishing agent supplied to the groove is applied to the passing filament, said groove having a width decreasing with an increase in the distance from the inlet thereof and having a narrowest portion at which the filament is to be brought into contact with the inner surface of the groove, and a lower part of said inner surface of the groove, including the narrowest portion, within a distance of at least 3 mm from the narrowest portion being made of a porous material to supply the finishing agent.

In a more preferred embodiment, the above lower part made of a porous material has a mean pore size of 0.1 to 10 μm.

DETAILED DESCRIPTION OF THE INVENTION

Figure 1:
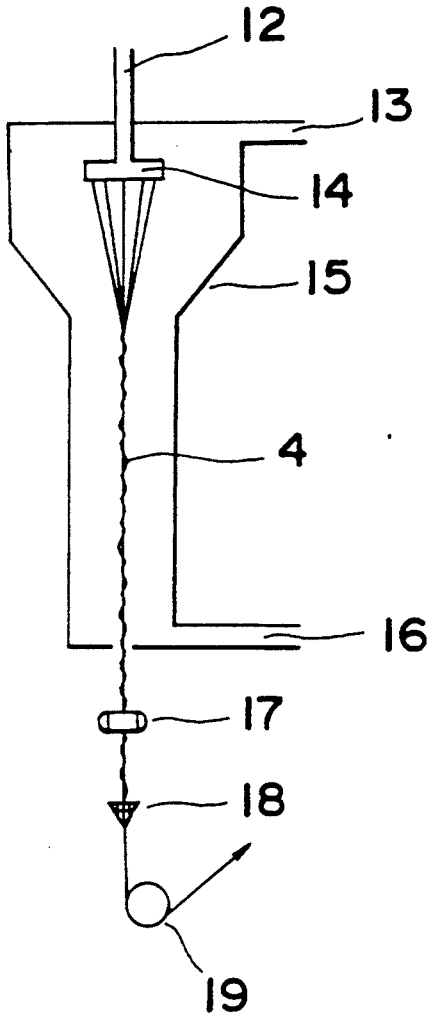
FIG. 1 is a schematic diagram of a typical apparatus for spinning of polyurethane elastic filaments.

The apparatus for spinning of polyurethane elastic filaments according to the present invention has substantially the same structure as that of the conventional apparatus as shown in FIG. 1, except for an improved means for application of a finishing agent and/or an improved means for false twisting. These improved means of the present invention can, therefore, be applied either to melt spinning apparatus or to dry spinning apparatus.

A finishing agent applying means of the present invention may comprise, in addition to a guide through which a polyurethane elastic filament is allowed to pass, a means for supplying a finishing agent to the guide, such as a pump, and a means for recovering excess finishing agent from the guide.

The following will illustrate the guide which is most important in the finishing agent applying agent of the present invention, with reference to the accompanying drawings.

Figure 2:
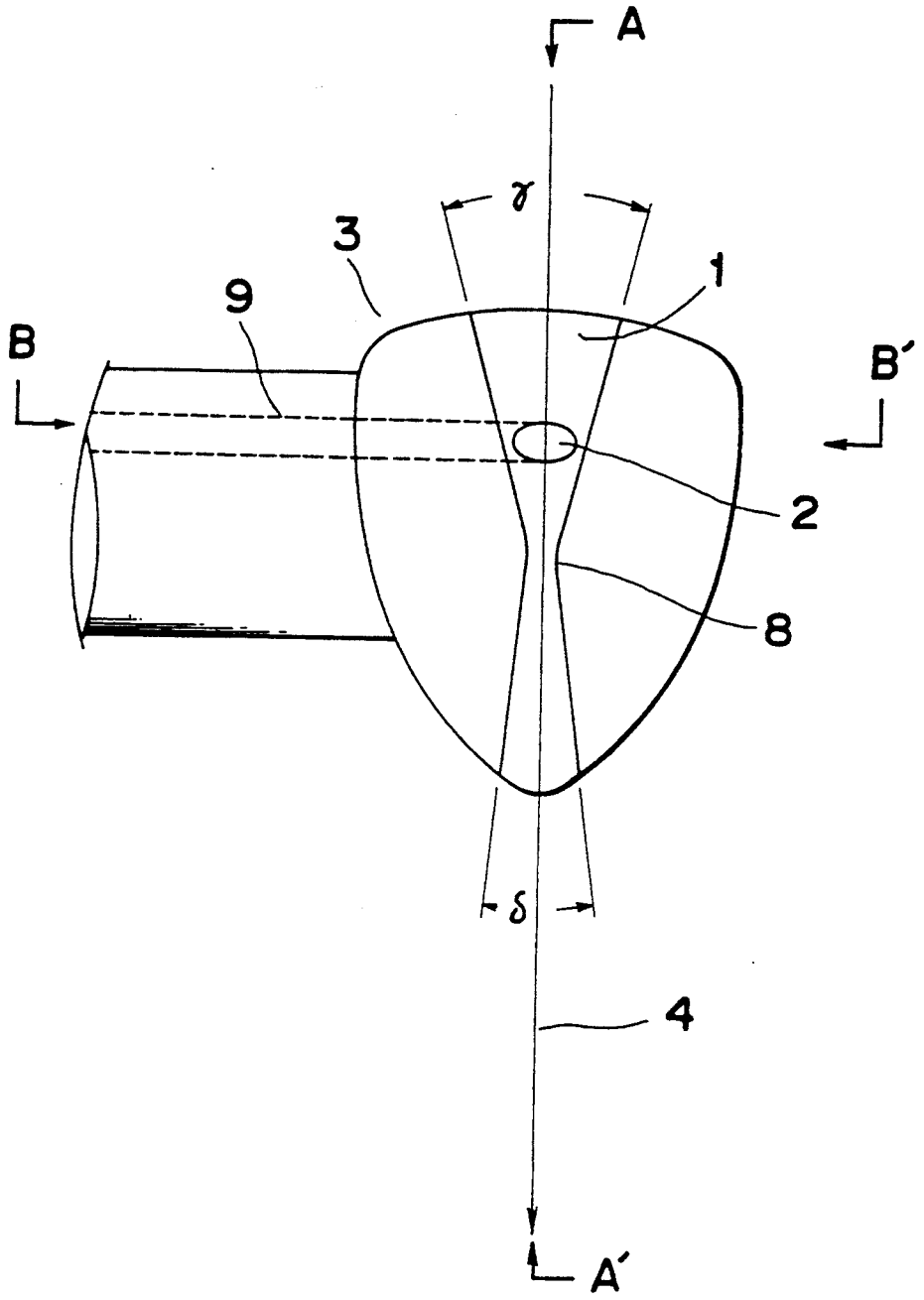
FIG. 2 is an enlarged front view of a guide provided in a finishing agent applying means of the present invention.
Figure 3:
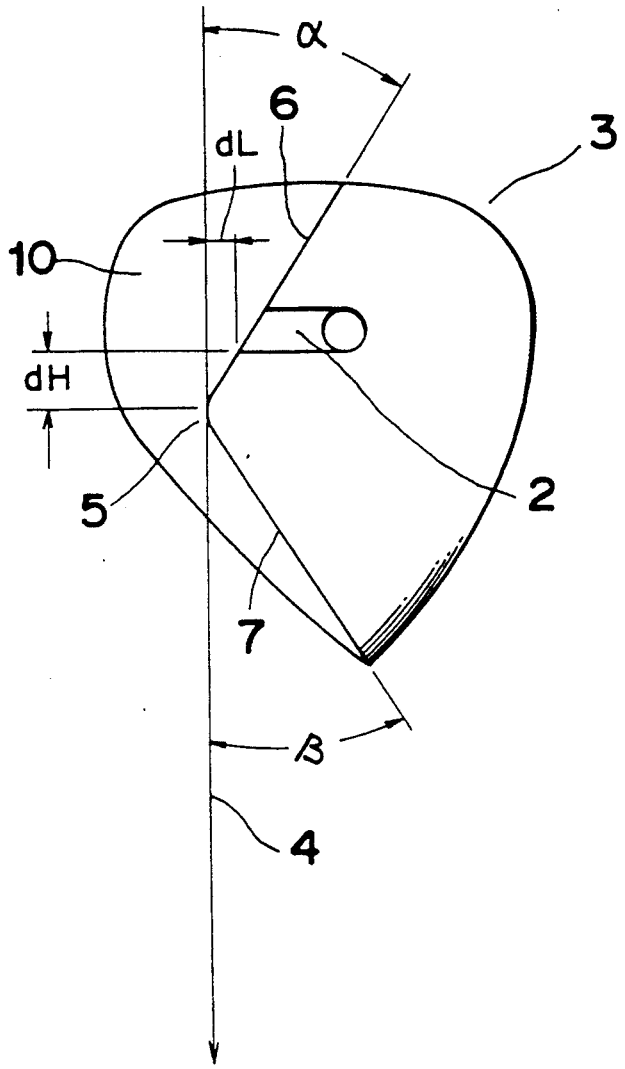
FIG. 3 is a partially sectional side view of the guide, the section being taken along the line A—A' of FIG. 2.
Figure 4:
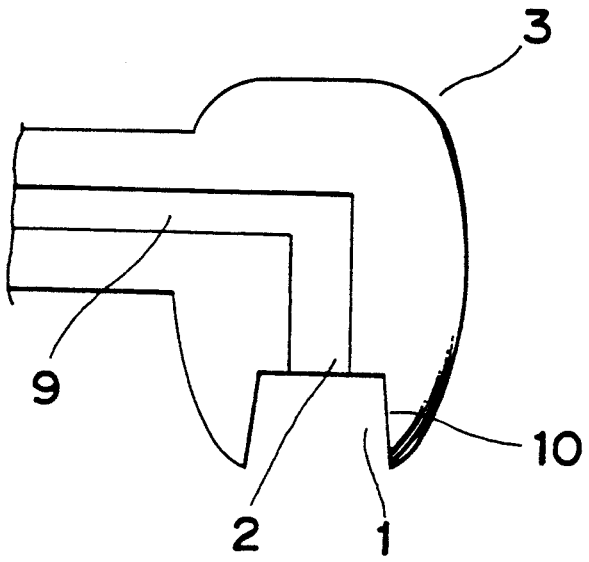
FIG. 4 is a sectional view of the guide, taken along the line B—B' of FIG. 2.
Figure 5:
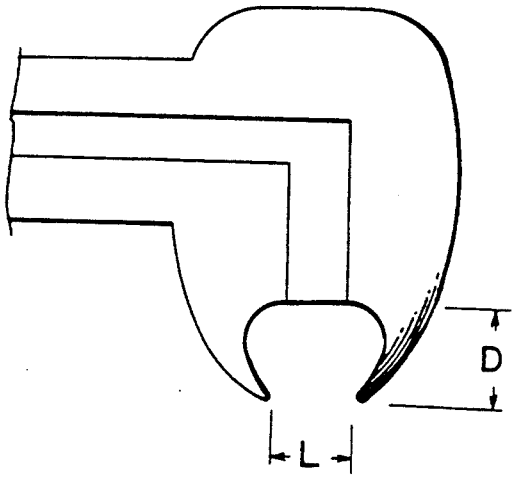
FIG. 5 is a sectional view of another guide, taken in the same manner as that of FIG. 4.

FIG. 2 shows the front view of the guide 3 of a finishing agent applying means of the present invention. FIG. 3 shows the section of the guide 3, taken along the line A—A' in FIG. 2. As seen from these figures, the guide 3 has a groove 1 which is substantially parallel to the running direction of the filament 4. The section of the groove 1, taken along the line B—B' of FIG. 2, may have a trapezoidal shape with flat sidewalls 10, as shown in FIG. 4, or may have any shape with curved sidewalls, for example, as shown in FIG. 5. The groove 1 is provided with an opening 2 for introducing a finishing agent thereinto, as shown in FIG. 2, and the opening 2 is connected to the conduit 9 for supplying the finishing agent.

As shown in FIG. 2, the groove 1 has a width decreasing with an increase in the distance from the inlet thereof toward the narrowest portion 8 and increasing with an increase in the distance from the narrowest portion 8 toward the outlet thereof. The groove t is not particularly limited to have a specific depth (e.g., D in FIG. 5). The inner surface of the groove 1 has an apex 5 (see FIG. 3) on the bottom of the groove 1 in the vicinity of the narrowest portion 8, at which the filament 4 is brought into contact with the guide 3. The inner surface of the groove also has an upper inclined plane 6 and a lower inclined plane 7, each of which extends from the apex 5 and makes an angle (i.e., $\alpha$ or $\beta$ in FIG. 3) away from the filament 4 in the depth direction of the groove 1. The apex 5, although it is not particularly limited to any shape, may have a rounded shape with a diameter in the range of 0.1 to 20 mm. It is important that the filament 4 is brought into contact with the guide 3 only at the apex 5; therefore, the angles $\alpha$ and $\beta$ are not particularly limited, but it is preferred that they are independently in the range of 15 to 70 degrees. The opening 2 is positioned upstream in the running direction of the filament 4 in such a manner that the minimum distance dH (see FIG. 3) from the apex 5 up to the opening 2 is at least 3 mm and the minimum distance dL (see FIG. 3) apart from the filament 4 is at least 2 mm, both of which are essential conditions to the present invention.

The lines used in FIGS. 1 and 2 to show the filament 4 are roughly drawn as a straight line to define the guide 3 of the finishing agent applying means of the present invention, although the filament 4 will not become completely straight in the actual case of spinning.

The opening 2 should meet another essential condition that its maximum diameter on the inner surface of the groove 1 is greater than the minimum value of the groove width (i.e., L in FIG. 5), that is, the groove width at the narrowest portion 8.

It is preferred that the groove 1 has a trapezoidal groove 1 takes a V-shaped form with an angle y, which becomes narrower from the upper part thereof toward the narrowest portion 8 in the vicinity of the apex 5, and also takes a reverse V-shaped form with an angle $\delta$, which becomes wider from the narrowest portion 8 toward the lower part. thereof, as shown in FIG. 2.

The opening 2 has a maximum diameter on the inner surface of the groove 1, which is preferably 0.2 to 0.4 mm greater than the minimum width L of the narrowest portion 8. The narrowest portion 8 of the groove 1 has a width L which is preferably in the range of 0.1 to 5 mm.

The guide 3 may be further provided with a kerf (not shown), which is smaller in width and depth than the groove 1 and extends on the lower inclined plane 7 from the apex 5 to the lowest point of the guide 3. At the lowest point of the guide 3, there is formed a peaked protrusion which serves for dropping of excess finishing agent. The dropped finishing agent is received in a pipe for recovery.

The angles $\gamma$ and $\delta$, although they are not particularly limited, are preferably in the range of 20 to 50 degrees.

The inner surface of the groove 1, particularly the apex 5, should be smooth, and the surface roughness of at least the apex 5 is preferably in the range of 2 to 10 S, more preferably 3 to 6 S.

When the finishing agent applying means is employed for spinning, a filament is allowed to pass through the groove 1 of the guide 3, so that a variation in the position thereof can be suppressed. Moreover, adverse effects on the stability of the filament, which may be caused by a variation in the friction at the fixed point (i.e., contact point) in the running direction (i.e., vertical direction) of the filament, can be remarkably decreased to attain excellent evenness of the filament. In particular, these advantages are significantly exhibited in the spinning of polyurethane elastic filaments.

The following will describe another finishing agent applying means of the present invention.

Figure 6:
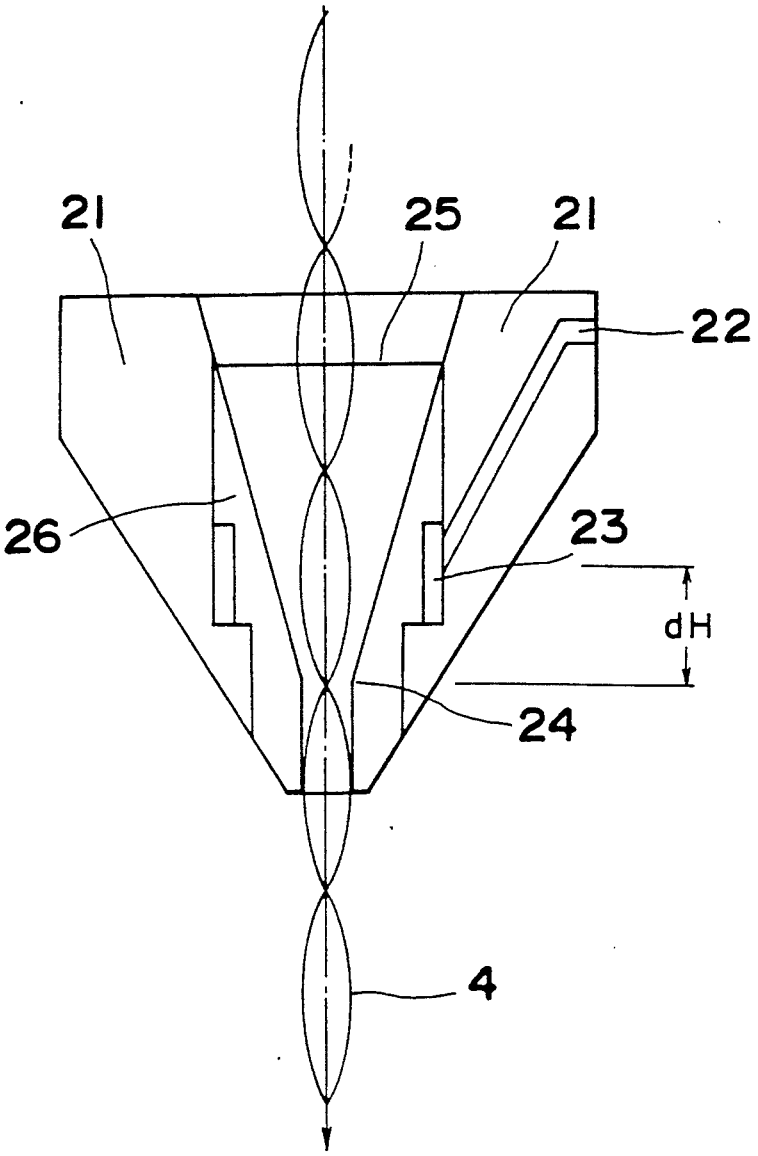
FIG. 6 is an enlarged partially sectional side view of another finishing agent applying means of the present invention, the section being taken along the vertical plane including the filament and the conduit for supplying a finishing agent.

FIG. 6 shows the section of this means. In this figure (and also FIGS. 7, 10 and 11 below), the filament 4 is not drawn as a straight line, because of its vibration (or revolution), which appears to be a series of streamline bubbles (or to be a twisted ribbon), occurring from the false twisting means 17 up to the vicinity of the spinning nozzle 14, when subjected to false twisting by the false twisting means 17, as shown in FIG. 1. At the point in the vicinity of the spinning nozzle 14, from which the vibration in a twisted ribbon form will start, a plurality of filaments are combined together to form a doubling filament yarn. It should be noted in these figures that the apparent shape of the filament 4 is drawn, i.e., these figures do not show that the doubling filament yarn is disintegrated into single filaments in a twisted ribbon form, but they show that the filaments combined into a doubling filament yarn are vibrating as a single filament yarn.

The groove 25 has a width decreasing along the running direction of the filament 4, i.e., with an increase in the distance from the inlet thereof. A lower part of the inner surface of the groove 25, including the narrowest portion 24, within a distance dH of at least 3 mm from the narrowest portion 24 is made of a porous material to form a porous portion 26, which is an essential condition of the present invention. The other portion 21 is made of an impermeable material. Behind the porous portion 26, there is formed a reservoir 23 for holding the finishing agent, which is connected to a conduit 22 for introducing the finishing agent into the reservoir 23.

The finishing agent supplied through the conduit 22 to the reservoir 23 exudes through the pores of the porous portion 26 into the groove 25. On the surface of the upper part of the porous portion 26, which is positioned higher than the narrowest portion 24 to be brought into contact with the filament 4, there is formed a liquid film of the finishing agent which is, therefore, applied to the filament 4 before its contact at the narrowest portion 24 (having, of course, a liquid film of the finishing agent on the surface thereof) with a solid face of the spinning apparatus of the present invention. Thus, it is possible to perform extremely stable spinning, and the resulting filament has excellent evenness. Moreover, the waviness and cramp in the filament, which may occur in the vicinity of the spinning nozzle 14 as shown in FIG. 1, are extremely smaller than those observed in any conventional spinning apparatus, showing the significantly excellent advantages attained by the spinning apparatus of the present invention.

The narrowest portion 24 may have a length of about 1 to 5 mm in the length direction (i.e, running direction of a filament) and have a uniform section over its whole-length. Alternatively, the narrowest portion 24 may have a shorter length than that and the lower part just below the narrowest portion 24 may be opened wider downstream in the running direction of the filament.

The porous portion 26 is formed from particles having a mean particle size, although it is not particularly limited, preferably of 0.5 to 10 μm. The material of these particles is not particularly limited, and examples thereof are ceramic materials such as silicon oxide ($SiO_2$), aluminum oxide ($Al_2O_3$), zirconium oxide, silicon carbide, silicon nitride, aluminum nitride, boron carbide and mixtures thereof; glass materials; polymer materials such as cross-linked polystyrene, polystyrene and polyurethane; and metal materials such as stainless steel and titanium. Preferred are ceramic materials and metal materials.

The porous portion 26 is preferably produced by sintering of the particles so as to have a mean pore size of 0.1 to 10 μm, preferably 0.5 to 2.0 μm. More preferably, the porous portion 26 has pores with a mean size of 0.6 to 1.5 μm at an occupation ratio of 95%.

The reservoir 23 for holding the finishing agent supplied through the conduit 22 is not necessarily provided between the porous portion 26 and the other portion 21.

Figure 7:
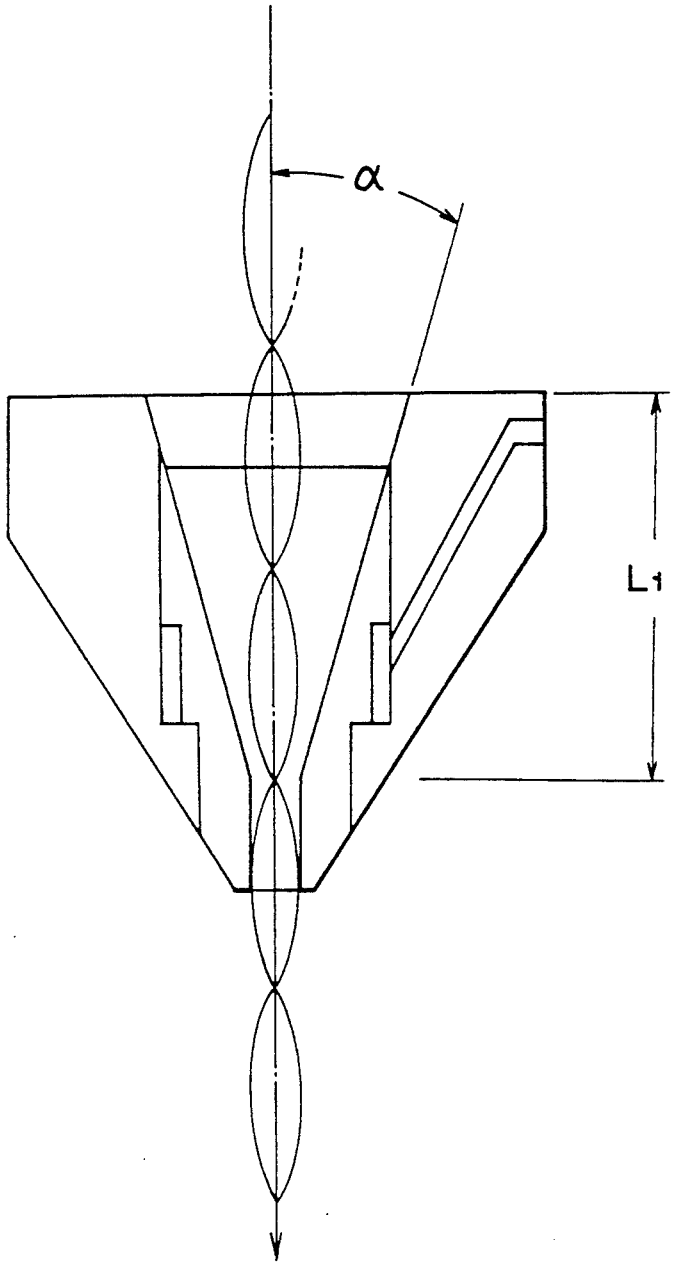
FIG. 7 is an enlarged partially sectional side view of the finishing agent applying means of FIG. 6, the section being taken in the same manner as that of FIG. 6, for explanation of the dimensions.

The dimensions (or sizes) of the respective portions shown in the drawings are not particularly limited and may vary depending upon the thickness of a filament and the like. As shown in FIG. 7, the distance $L_1$ from the inlet of the groove 25 to the narrowest portion 24 is preferably in the range of 10 to 50 mm and the angle $\alpha$ between the filament 4 and the inclined plane of the groove 25 is preferably in the range of 5 to 40 degrees, more preferably 10 to 25 degrees.

Figure 8:
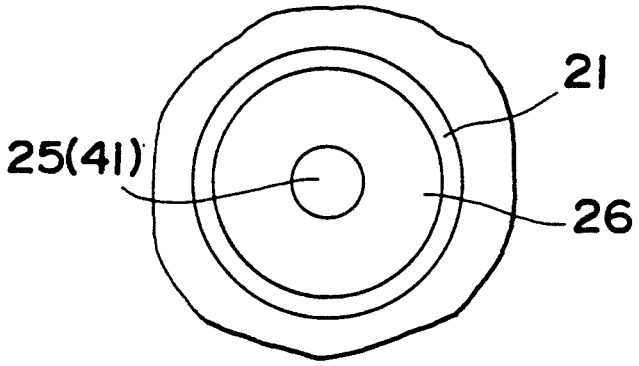
FIG. 8 is an enlarged fragmentary view of the inlet part of the finishing agent applying means of FIG. 6.
Figure 9:
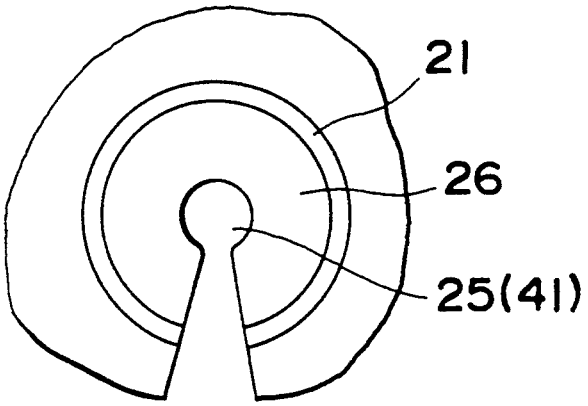
FIG. 9 is an enlarged fragmentary view of the inlet part of another finishing agent applying means of the present invention.

The section of the groove 25, although it is not particularly limited, may preferably have a circular shape, as shown in FIG. 8, for attaining good processability and fully exhibiting the excellent advantages of the present invention. The section of the groove 25 may have a partially notched circular shape, as shown in FIG. 9. For example, the angle between the opposite faces of the notched portion, as shown in FIG. 9, is not greater than 90 degrees, preferably not greater than 60 degrees.

The other portion 21 is formed from an impermeable material, which is not particularly limited, so long as it is not permeable to liquid finishing agents such as oils. The impermeable material may be the same as used for the porous portion 26.

The following will describe a false twisting means of the present invention, in which a part of the finishing agent is supplied to the false twisting means for the purpose of suppressing a variation in the frictional resistance at the time of false twisting as small as possible and the remaining part of the finishing agent is applied to the false twist filament by the finishing agent applying means, so that it is possible to obtain false twist filaments with excellent evenness (i.e., exhibiting only a small variation and small scattering of the quality), which has been treated with a required amount of finishing agent.

Figure 10:
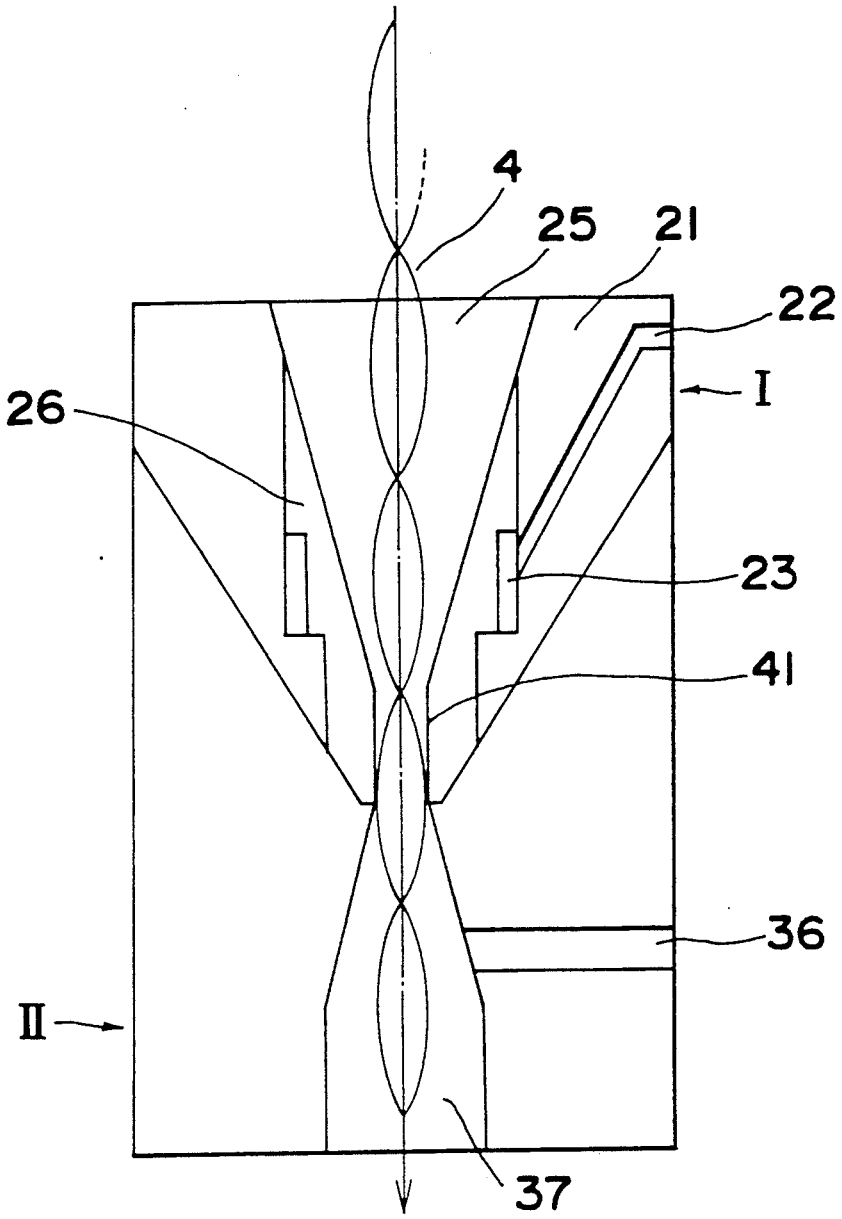
FIG. 10 is an enlarged partially sectional side view of a false twisting means of the present invention, the section being taken along the vertical plane including the filament and the conduit for supplying a finishing agent.
Figure 11:
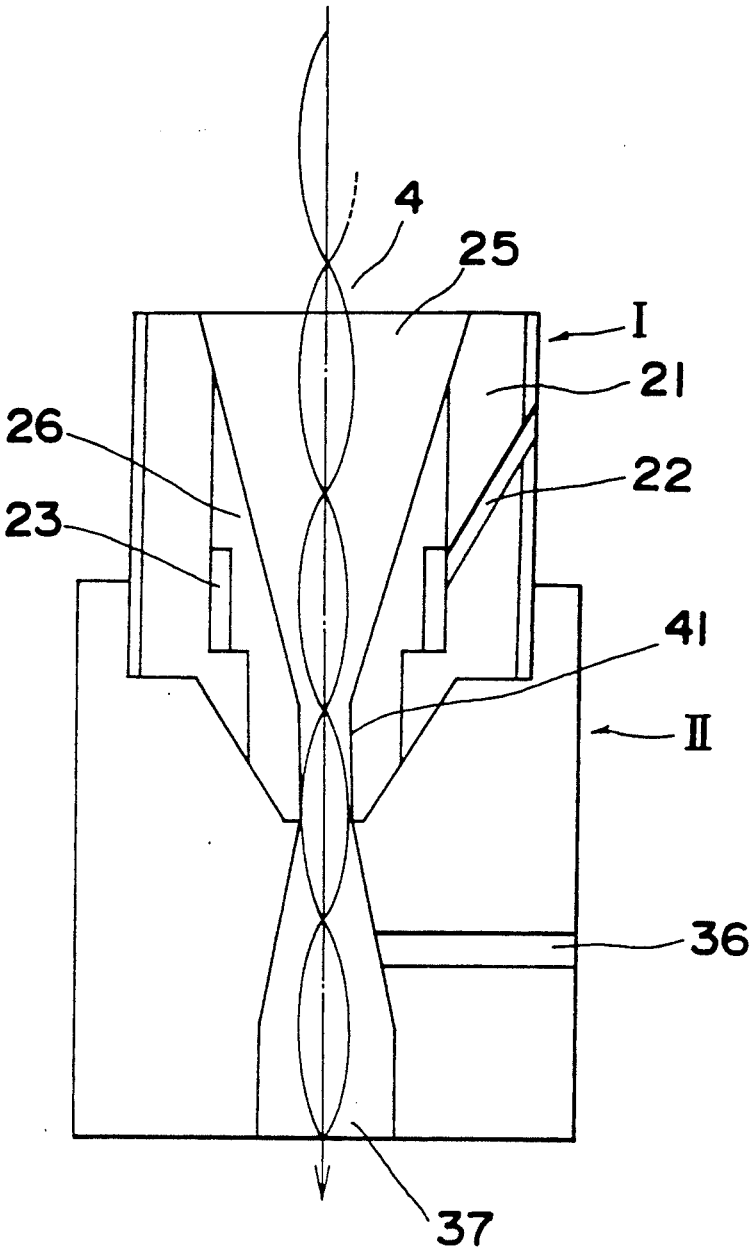
FIG. 11 is an enlarged partially sectional side view of another false twisting means of the present invention, the section being taken in the same manner as that of FIG. 10.

FIGS. 10 and 11 show the respective sections of two false twisting means of the present invention. Each of these means is composed of a finishing agent applying portion I and a false twisting portion II. The filament 4 directed to the false twisting means is introduced into the groove (or slit) 25 of the portion I. The groove 25 has the narrowest portion 41, and a lower part of the inner surface of the groove 25, including the narrowest portion 41, within a distance of at least 3 mm from the narrowest portion 41 is made of a porous material to form a porous portion 26. The other portion 21 around the porous portion 26 is made of an impermeable material, and a reservoir 23 for holding a finishing agent is formed between the porous portion 26 and the other portion 21. The finishing agent supplied through a conduit 22 to the reservoir 23 exudes through the pores of the porous portion 26 into the groove 25, resulting in a liquid film of the finishing agent on the inner surface of the groove 25, so that the finishing agent is applied to the filament 4 before its false twisting.

The filament 4 thus treated with the finishing agent by passing through the groove 25 is then introduced into the conduit 37 of the false twisting portion II for false twisting, which is integrated with the finishing agent applying portion I. The false twisting portion II, although it is not particularly limited to specific ones, may be a conventional one, as an example. The conduit 37 of the portion II has an opening 36 formed on the inner surface thereof and the opening 36 extends in the vertical direction to the conduit 37. The opening 36 is used for introduction of a gas into the conduit 37. The gas supplied through the opening 36 to the conduit 37 forms a revolving flow which is exhausted through the outlet of the conduit 37. The filament 4 is subjected to false twisting by the revolving flow, when introduced into the conduit 37 of the portion II.

It is preferably that the groove 25 has an inverted conical shape. The porous portion 26 is formed from particles having a mean particle size, although it is not particularly limited, preferably in the range of 0.5 to 10 μm. The porous portion 26 has a mean pore size of 0.1 to 10 μm, preferably 0.5 to 2.0 μm. More preferably, the porous portion 26 has pores with a mean size of 0.6 to 1.5 μm at an occupation ratio of 95%.

The material of these particles is not particularly limited, and examples thereof are ceramic materials such as silicon oxide ($SiO_2$), aluminum oxide ($Al_2O_3$), zirconium oxide, silicon carbide, silicon nitride, aluminum nitride, boron carbide and mixtures thereof; glass materials; polymer materials such as cross-linked polystyrene, polystyrene and polyurethane; and metal materials such as stainless steel and titanium. Preferred are ceramic materials and metal materials.

The false twisting means shown in FIGS. 10 and 11 are only illustrative, and the spinning apparatus of the present invention is not limited thereto. In addition to a structure in which the finishing agent applying portion I and the false twisting portion II are directly connected with each other, as shown in FIGS. 10 and 11, the false twisting means of the present invention may have another structure in which the portions I and II are connected through a thick conduit or the like. It is preferred as a matter of course in view of the excellent advantages of the present invention that the finishing agent applying portion I is positioned upstream in the running direction (indicated by thick arrows in FIGS. 10 and 11) of the filament 4 (i.e., on the opposite side of the direction pointed by these thick arrows) from the false twisting portion II. Both of the portions I and II are preferably integrated into one piece, as shown in FIGS. 10 and 11.

In a spinning apparatus of the present invention where a part of the finishing agent to be applied by the finishing agent applying means is distributed to the false twisting means, the finishing agent is preferably supplied to the false twisting means at a ratio of 0.05 to 0.5, more preferably 0.1 to 0.4, based on the total weight of finishing agent to be required for application.

The finishing agent applying means to be disposed downstream in the running direction of the filament from the false twisting means used in a spinning apparatus of the present invention, although it is not particularly limited, may take either a conventional roller system or a conventional guide system. It is, however, preferred that the finishing agent applying means as previously described herein is used, together with the false twisting means as described above, in the spinning apparatus of the present invention.

The finishing agent which can be used in the present invention are not particularly limited. Examples of the finishing agent are lubricants such as oils, antistatic agents, softeners, colorants such as dyes, water repellents, wetting agents and surfactants. These finishing agents may be used in a solution or emulsion form. When a finishing agent is applied as a liquid material to a filament, the frictional resistance of the filament is decreased, as compared with the value observed in direct contact with any solid face of the apparatus. Thus, it contributes to the suppression of a variation in the frictional resistance at the time of various treatments, e.g., false twisting as a typical example.

The present invention will be further illustrated with reference to the following examples and comparative examples, which are not construed to limit the scope thereof.

EXAMPLE 1

A finishing agent applying means provided with a guide 3 having a shape as shown in FIGS. 2 and 3 was produced, and this means was disposed in an apparatus for spinning of polyurethane elastic filaments as shown in FIG. 1. The guide 3 was formed from an $Al_2O_3$ ceramic material. As shown in FIG. 4, the guide 3 had a groove 1 with a trapezoidal section as taken along the line B—B' of FIG. 2. The inner surface of the groove 1 had a roughness of 5 S, and the angles $\beta$, $\gamma$ and $\delta$ were 25, 20 and 15 degrees, respectively. The whole length of the guide 3 in the running direction of a filament, as shown in FIG. 3, was 26 mm. The apex 5 had a size of 0.6 mm, and the dimensions dH and dL were 3.5 mm and 3.0 mm, respectively. The minimum width of the groove 1 at the narrowest portion 8 was 2.5 mm, and the maximum diameter of the opening 5 was 2.8 mm in the width direction of the groove 1.

Using the spinning apparatus provided with the above finishing agent applying means, polyurethane elastic filaments was spun at a fixed spinning speed to form a 40 denier filament consisting of 5 strands. At that time, an oil was used as a finishing agent. The amount of oil applied was 6% by weight, based on the weight of the filament (owf).

The resulting elastic filament was tested for evenness in U% by measurement with Evenness Tester, model KET 80C (Keisokuki Kogyo Co., Ltd.). The working efficiency in spinning was evaluated as the number of filament breaking per 120 hours. The results are shown in Table 1.

EXAMPLE 2

Another finishing agent applying means provided with the same guide as described in Example 1, except that the inner surface of the groove 1 had a roughness of 25 S, was produced. A spinning apparatus provided with the finishing agent applying means was used for spinning of polyurethane elastic filaments, and the resulting elastic filament was tested for evenness and working efficiency in the same manner as described in Example 1. The results are shown in Table 1.

COMPARATIVE EXAMPLE 1

For comparison, a conventional spinning apparatus provided with a finishing agent applying means of the roller system or substantially the same guide system as described in U.S. Pat. No. 4,329,750 was used for spinning of polyurethane elastic filaments, and the resulting elastic filament was tested for evenness and working efficiency in the same manner as described in Example 1. The results are shown in Table 1.

TABLE 1

| | Spinning speed: 500 m/min | | Spinning speed: 1000 m/min | |
|---|---|---|---|---|
| | Evenness (U %) | Breaking (times) | Evenness (U %) | Breaking (times) |
| Example 1 | 1.5 | 0.01 | 1.7 | 0.015 |
| Example 2 | 1.9 | 0.02 | 2.2 | 0.025 |
| Comp. Ex. 1 | | | | |
| Roller system | 3.8 | 0.05 | 5.9 | 0.10 |
| Guide system | 3.6 | 0.04 | 6.2 | 0.08 |

It is found from Table 1 that polyurethane elastic filaments with little scattering of applied oil amount and filament evenness can be obtained by use of a spinning apparatus provided with the improved finishing agent applying means of the present invention.

This is because the finishing agent (e.g., oil in the above examples) was applied to the filament before its contact with any solid face of the apparatus for the purpose of controlling the running position of the filament and suppressing a variation thereof; the frictional resistance was, therefore, decreased and kept even over the filament, resulting in a polyurethane elastic filament with extremely even characteristics.

EXAMPLE 3

A false twisting means as shown in FIG. 10 was produced with a porous portion being made of sintered silicon oxide. The mean pore size and the surface smoothness thereof were 1.5 $\mu$m and 5 $\mu$m, respectively. A finishing agent applying means as shown in FIG. 6 was also produced with a porous portion being made of the same material as that of the false twisting means. These means were disposed in a spinning apparatus as shown in FIG. 1.

Then, poly(tetramethylene ether glycol) having hydroxy groups at both ends (number average molecular weight, 2000) was reacted with 4,4'-diphenylmethane diisocyanate at a molar ratio of 1:2 to give a prepolymer, which was then subjected to chain extension with 1,2-propylene diamine to give a polyurethane solution in dimethylformamide with a polymer concentration of 30% and a viscosity of 2000 poise at 30° C. To this solution, an antioxidant, an ultraviolet-absorbing agent, and an anti-yellowing agent were added, and the mixture was well mixed with stirring to give a spinning solution.

The spinning solution thus obtained was degassed and used for dry spinning by use of the above spinning apparatus with a spinning nozzle having 5 orifices of each 0.2 mm in diameter at a drying hot-air temperature of 180° C. at a spinning speed of 700 m/min., resulting in a 40 denier filament of polyurethane.

At that time, an oil was applied as a finishing agent to the filament at a ratio of 2% owf in the false twisting means and the subsequent application of the remaining finishing agent in the finishing agent applying means was controlled to a final ratio of 6%.

The polyurethane elastic filament thus obtained was tested for evenness in U% by measurement with Evenness Tester, model KET 80C (Keisokuki Kogyo Co., Ltd.). The strength and elongation were measured with Tensilon, model UTM-III (Orientic Co., Ltd.). The working efficiency in spinning was evaluated as the number of filament breaking per 120 hours. The results are shown in Table 2.

EXAMPLE 4

The same polyurethane solution was prepared and used for dry spinning under the same conditions as those described in Example 3, except that a conventional false twisting means of the dry type was used in place of the false twisting means of the present invention. The filament was treated with an oil as a finishing agent in the same manner as described in Example 3, and wound up on a roller.

The resulting polyurethane elastic filament was tested in the same manner as described in Example 3. The results are shown in Table 2.

COMPARATIVE EXAMPLE 2

A polyurethane elastic filament was obtained from the same polyurethane solution under the same conditions as described in Example 3, except that a conventional false twisting means of the dry type was used in place of the false twisting means of the present invention and the application of a finishing agent was performed with a conventional roller system. At that time, filament breaking was frequently observed, as compared with the case of Example 3, so that the spinning apparatus used in this comparative example was not suitable for actual operation.

The resulting polyurethane elastic filament was tested in the same manner as described in Example 3. The results are shown in Table 2.

TABLE 2

| | Evenness (U %) | Strength (g/d) | Elongation (%) | Breaking (times) |
|---|---|---|---|---|
| Example 3 | 1.4 | 1.47 | 440 | 0.01 |
| Example 4 | 1.8 | 1.51 | 430 | 0.02 |
| Com. Ex. 2 | 3.8 | 1.50 | 410 | 0.05 |

EXAMPLE 5

A polyurethane elastic filament was obtained from the same polyurethane solution under the same conditions as described in Example 3, except that the filament had a thickness of 37.1 denier, and that a false twisting means as shown in FIG. 11, with the porous portion 26 being made of sintered silicon oxide and having a mean pore size of 1.5 μm and a surface roughness of 5 μm, was used in place of the false twisting means as shown in FIG. 10, and a finishing agent applying means with the guide 3 having a shape as shown in FIGS. 2 and 3 was used in place of the finishing agent applying means as shown in FIG. 6.

The resulting polyurethane elastic filament was tested in the same manner as described in Example 3. The results are shown in Table 3.

COMPARATIVE EXAMPLE 3

A polyurethane elastic filament was obtained from the same polyurethane solution under the same conditions as described in Example 3, except that a conventional false twisting means of the dry type (the ratio of oil applied was 0%) was used in place of the false twisting means of the present invention, and the application of a finishing agent was performed with a conventional roller system (the ratio of oil applied was 6%).

As compared with the case of Example 5, the false twisting was unstable, so that the value of evenness in U% was increased. The filament thus obtained was found to be a product with poor quality, because numerous deposited spots of the finishing agent appeared thereon. It was also observed that the filament caused a vigorous vibration in spinning, as compared with the case of Example 5.

The resulting polyurethane elastic filament was tested in the same manner as described in Example 3. The results are shown in Table 3.

COMPARATIVE EXAMPLE 4

A polyurethane elastic filament was obtained from the same polyurethane solution under the same conditions as described in Example 3, except that the false twisting means as shown FIG. 11 (the ratio of oil applied was 0%), which was the same as used in Example 5, was used in place of the false twisting means as shown in FIG. 10, and the application of a finishing agent was performed with a conventional roller system (the ratio of oil applied was 6%).

As compared with the case of Example 5, the false twisting was stable, so that the value of evenness in U% was kept constant over the filament. The filament thus obtained was, however, found to have numerous deposited spots of the finishing agent, and there was a tendency to increase the number of filament breaking, as compared with the case of Example 5.

The resulting polyurethane filament was tested in the same manner as described in Example 3. The results are shown in Table 3.

TABLE 3

| | Evenness (U %) | Strength (g/d) | Elongation (%) | Breaking (times) |
|---|---|---|---|---|
| Example 5 | 1.4 | 1.47 | 440 | 0.01 |
| Com. Ex. 3 | 3.9 | 1.48 | 420 | 0.05 |
| Com. Ex. 4 | 3.7 | 1.46 | 430 | 0.04 |

What is claimed is:

1. An apparatus for spinning of polyurethane elastic filaments, which comprises:

a spinning nozzle through which a polyurethane material is extruded to form a polyurethane elastic filament;

a means for application of a finishing agent to the filament, which is arranged downstream in the running direction of the filament from the spinning nozzle, said means having a guide provided with a groove through which a filament is allowed to pass from an inlet to an outlet of the groove, the groove having a bottom and sidewalls, an opening formed on the bottom of the groove for supplying a finishing agent to the passing filament, said bottom of the groove defined by an upper inclined plane and a lower inclined plane which form an apex extending into the groove at which the filament is to be brought into contact with the guide, the upper inclined plane and the lower inclined plane making respective angles away from the passing filament in the depth direction of the groove with an increase in distance from the apex, said groove having a width between the sidewalls which decreases from the inlet toward a narrowest portion of the groove width in the vicinity of the apex and which increases from the narrowest portion toward the outlet, said opening for supplying the finishing agent being formed at a position at least 3 mm higher than that of the apex and at least 2 mm apart from the filament, and said opening also having a diameter greater than the groove width at the narrowest portion; and a roller for winding up the filament thus treated with the finishing agent.

2. A spinning apparatus according to claim 1, wherein the degree of surface roughness at the apex of the finishing agent applying means is 2 to 10 S.

3. A spinning apparatus according to claim 1, wherein the angle between the upper inclined plane and the filament and the angle between the lower inclined plane and the filament are independently in the range of 15 to 70 degrees in the depth direction of the groove and angles formed between the sidewalls in the width direction of the groove respectively above and below the apex are in the range of 20 to 50 degrees in the width direction of the groove.

4. A spinning apparatus according to claim 1, wherein the narrowest portion has a width in the range of 0.1 to 5 mm.

5. A spinning apparatus according to claim 1, wherein the opening for supplying a finishing agent has a maximum diameter on the bottom of the groove, which is 0.2 to 0.4 mm greater than the minimum width of the groove at the narrowest portion.

* * * * *